United States Patent [19]

Thomson, Jr.

[11] Patent Number: 4,580,661

[45] Date of Patent: Apr. 8, 1986

[54] GUTTER PROTECTOR

[76] Inventor: William E. Thomson, Jr., 407 Arabian Dr., Raymore, Mo. 64083

[21] Appl. No.: 771,511

[22] Filed: Aug. 30, 1985

[51] Int. Cl.[4] ..... E06C 7/48

[52] U.S. Cl. ..... 182/107; 182/206; 182/214; 52/11

[58] Field of Search ..... 182/206, 214, 107, 108; 52/11; 248/210

[56] References Cited

U.S. PATENT DOCUMENTS

| | | | |
|---|---|---|---|
| 1,374,060 | 4/1921 | Chute | 182/107 |
| 3,115,212 | 12/1963 | Keatley | 182/108 |
| 3,853,202 | 12/1974 | Jarboe | 182/108 |
| 3,948,353 | 4/1976 | Lane | 182/107 |
| 4,185,421 | 1/1980 | Robinson | 52/11 |
| 4,311,210 | 1/1982 | Jackson | 182/107 |
| 4,369,860 | 1/1983 | Beane | 182/214 |
| 4,444,291 | 4/1984 | McPherson | 182/107 |

*Primary Examiner*—Reinaldo P. Machado

*Attorney, Agent, or Firm*—Kokjer, Kircher, Bradley, Wharton, Bowman & Johnson

[57] ABSTRACT

A gutter protection device for preventing damage to an eaves-mounted gutter against which a ladder is leaned. A polyethylene foam block forms the body of the device. A semi-circular recess in one face of the body can be fitted on the lip of the gutter. A pair of pins which project from the body into the recess are then hooked behind the gutter lip to mount the device on the gutter. A bearing surface of the body has a pair of slots which receive the legs of the ladder. One slot closely receives the leg of the ladder to assist in preventing sideward sliding of the ladder. The other slot is oversized so that it can receive the legs of ladders having various sizes.

20 Claims, 5 Drawing Figures

GUTTER PROTECTOR

BACKGROUND OF THE INVENTION

This invention relates to a gutter protection device which is interposed between a roof mounted gutter and a ladder which is leaned against the gutter.

When painting and other work is to be performed on elevated areas of a house or other building, or when access to the roof is necessary, it is common practice to use an extension ladder which is typically leaned against the gutter on the eaves of the building. Leaning of the ladder directly against the gutter often causes the chipping of paint from the gutter, unsightly dents in the outer edge of the gutter, and other damage to the gutter and/or ladder. Another problem is that there is ordinarily little to prevent the ladder from sliding to the side along the gutter. Consequently, the ladder can easily fall and cause severe injury to persons working from the ladder or climbing up and down on it.

Various types of ladder accessories have been proposed to protect gutters against damage caused by ladders and/or to enhance the stability of the ladder by preventing it from sliding on the gutter. For example, U.S. Pat. Nos. 4,444,291 and 3,853,202 disclose the use of brackets extending from the ladder into the gutter to secure the ladder against slipping. These devices are somewhat complicated to construct and use and must be repositioned on the ladder from time to time, all of which has contributed to their lack of commercial acceptance. U.S. Pat. No. 4,369,860 shows a similar device which must be detached and reconnected by U-bolts each time it is applied to a different rung of the ladder. The device shown in U.S. Pat. No. 4,185,421 requires that spikes be driven into the fascia board on which the gutter is mounted, and it is thus difficult at best to move the device when the ladder is to be repositioned.

SUMMARY OF THE INVENTION

The present invention is directed to a device which serves both to protect an eaves mounted gutter and helps to stabilize a ladder which is leaned against the gutter. In accordance with the invention, the body of the device is formed by a block which is constructed from polyethylene rigid foam or a similar material. The surface of the block which confronts the gutter is provided with a curved recess which fits on the outer edge of the gutter. A pair of pins project from the body into the recess and may be hooked behind the lip of the gutter to hold the body in place. The body has a bearing surface which is substantially maintained at the approximate angle of inclination of the ladder so that the ladder can be leaned against it in a stable manner. The bearing surface includes a pair of slots for receiving the legs of the ladder, and one slot is oversized so that ladders having different sizes can be accommodated.

The device prevents the ladder from directly contacting the gutter and thus prevents damage such as dents in the gutter and chipping away of paint. The weight is distributed along the entire length of the foam block to provide stability and prevent the load from being concentrated on a small area. At the same time, the load is effectively transmitted to the top outer edge of the gutter and the bowed outer wall thereof rather than being concentrated at any relatively weak surface. The cushioning effect provided by the foam block adds to the stability, and the block can be moved to different positions on the gutter when the ladder is to be moved. During use of the ladder, the slots help prevent it from sliding to the side and thereby significantly enhance its safety and stability.

DETAILED DESCRIPTION OF THE INVENTION

In the accompanying drawings which form a part of the specification and are to be read in conjunction therewith and in which like reference numerals are used to indicate like parts in the various views.

Figure 1:
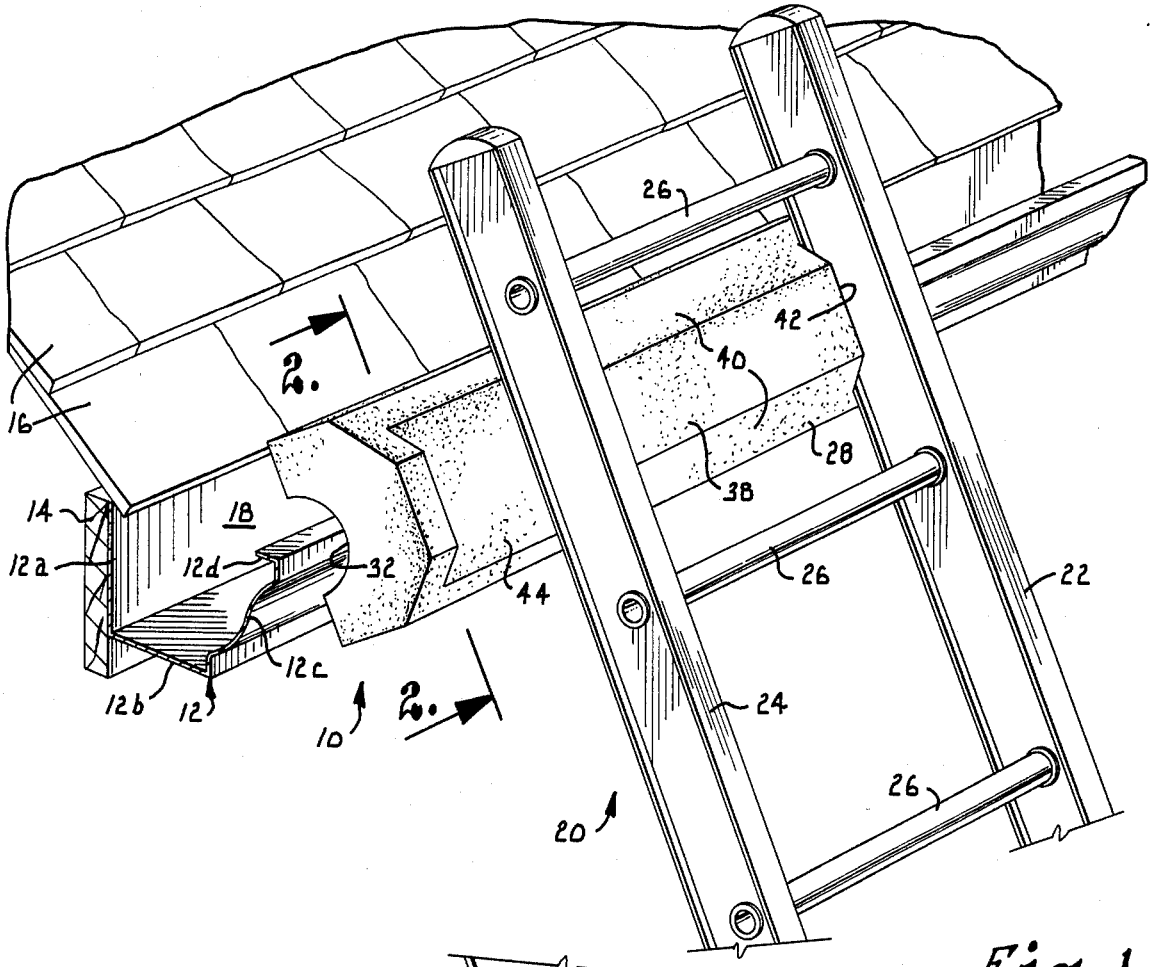
FIG. 1 is a fragmentary perspective view showing the device of the present invention applied to a roof mounted gutter with a ladder leaned against the device.
Figure 2:
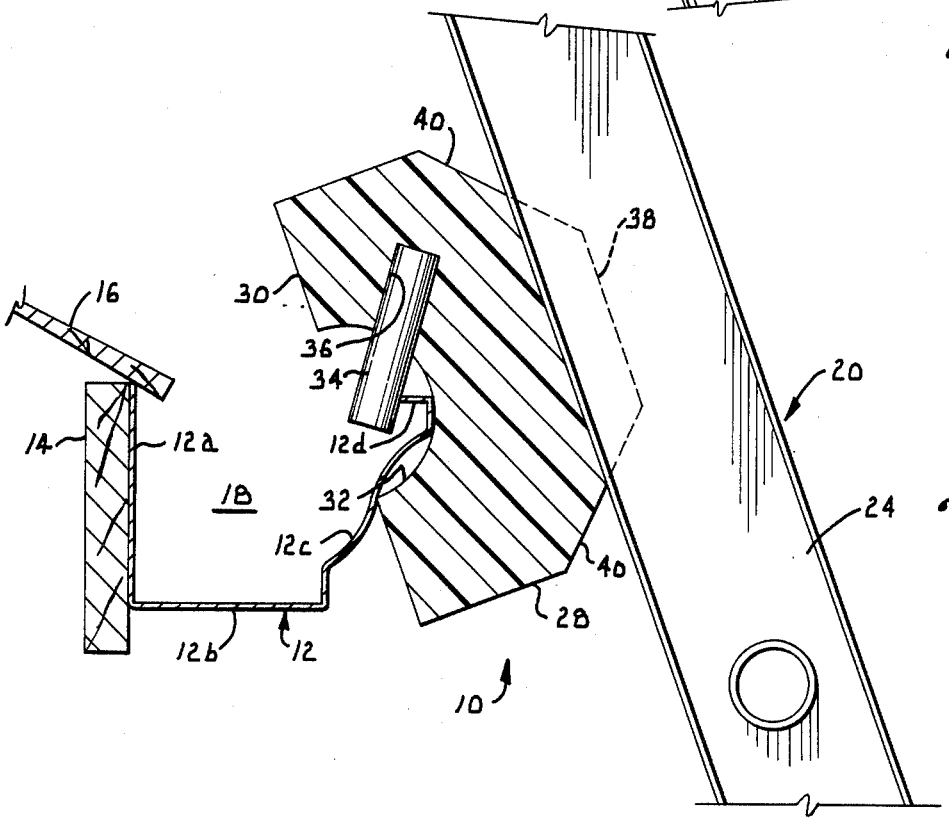
FIG. 2 is a fragmentary sectional view on an enlarged scale taken generally along line 2—2 of FIG. 1 in the direction of the arrows.
Figure 3:
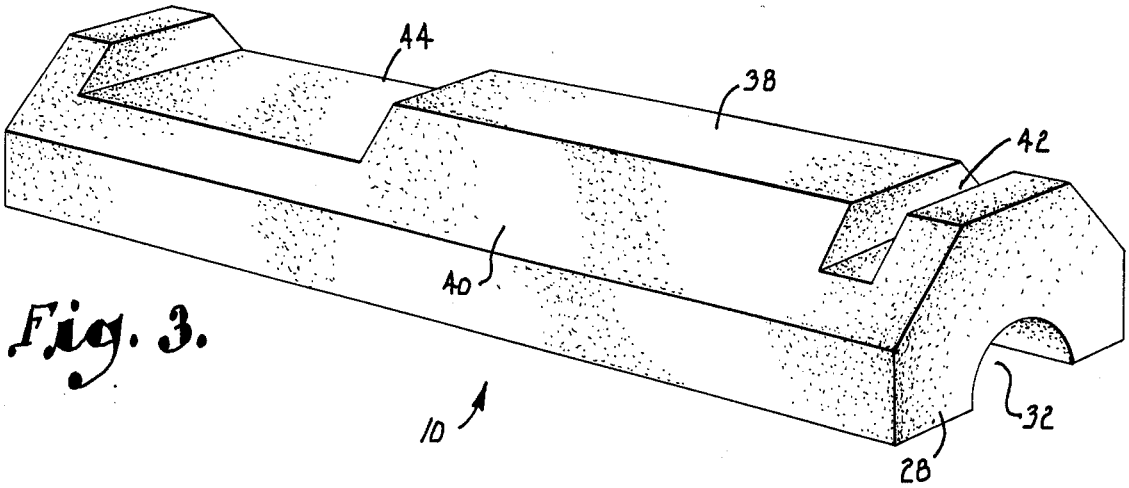
FIG. 3 is a perspective view of the device taken from one side.

Referring now to the drawings in more detail and initially to FIGS. 1 and 2, numeral 10 generally designates a gutter protection device constructed in accordance with a preferred embodiment of the present invention. The device 10 may be applied to a roof mounted gutter which is generally designated by numeral 12 and which is secured to a fascia board 14 extending along the eaves of a building roof covered by shingles 16. The gutter 12 has a back wall **12*a* which is secured to the fascia board 14. A bottom panel 12*b* of the gutter cooperates with the back wall 12*a* and with an outer wall 12*c* to form a trough 18 for collecting rain water which drains from the roof. The outer wall 12*c* is bowed in a compound curvature, and its upper edge is provided with an in turned lip 12*d***.

The device 10 serves to prevent the gutter 12 from being damaged when a ladder 20 must be leaned against the gutter. The ladder 20 may be a conventional two-legged extension ladder having a pair of parallel legs 22 and 24. Horizontal rungs 26 extend between the legs 22 and 24 in the usual manner.

Referring now more particularly to the construction of the gutter protecting device 10, a body 28 of the device is formed from a block of foam or another material having suitable cushioning properties. The body 28 has a length considerably greater than the width of ladder 20 between the legs 22 and 24. The body has a flat inside face 30 which confronts the gutter 12 during use of the device. A semi-circular recess 32 is formed in face 30 and extends the entire length of the body 28.

Figure 4:
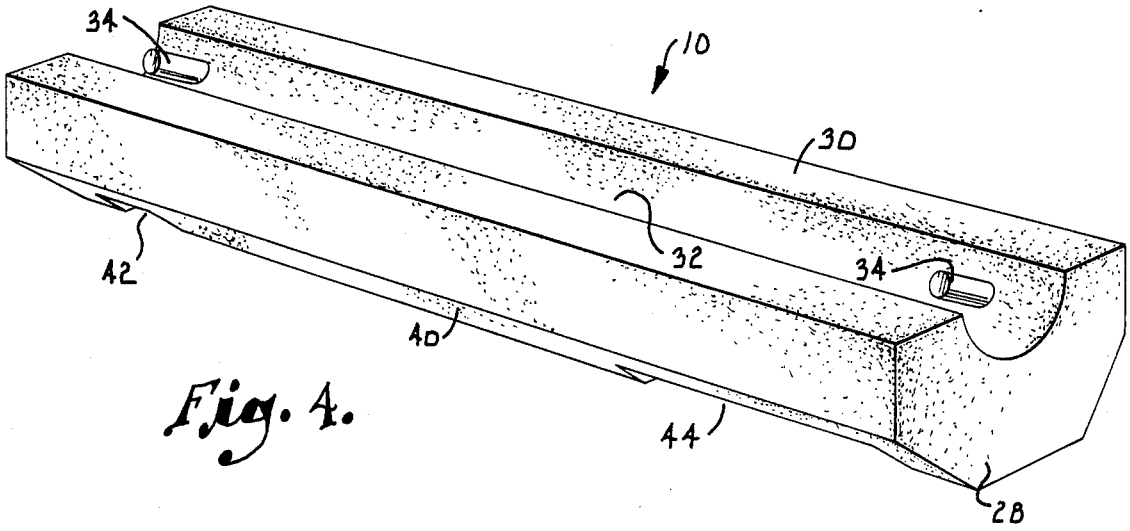
FIG. 4 is a perspective view similar to FIG. 3 but rotated clockwise 180°.

A pair of wooden pegs or pins 34 extend from body 28 into the recess 32. As best shown in FIG. 4, the pins 34 are located near the opposite ends of the body. Each pin 34 is fitted in a passage 36 (see FIG. 2) which is formed in body 28 adjacent the recess 32. The pins 34 are glued or otherwise suitably secured in the passages 36. Preferably, each pin 34 has its axis oriented at an angle of approximately 35° to the plane of face 30. The tip of each pin terminates adjacent to the plane of face 30 so that each pin projects well into the recess 32.

Figure 5:
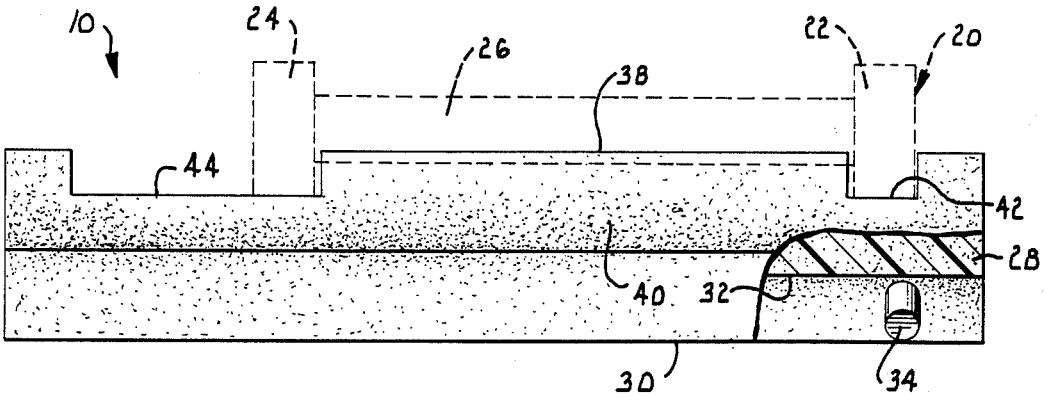
FIG. 5 is a side elevational view of the device shown in FIG. 3, with a portion broken away for purposes of illustration and the ladder shown in broken lines.

Body 28 has an outside bearing surface 38 which is opposite face 30 and which receives the ladder 20. The corners of body 28 adjacent the bearing surface 38 are beveled at 40. The bearing surface 38 is provided with a pair of spaced apart slots 42 and 44. Slot 42 is located near one end of the body and has a width to closely receive one of the legs 22 of the ladder. The fit of leg 22 in slot 42 is close enough to prevent the leg from moving from side to side in the slot to any significant extent. The other slot 44 is located near the opposite end of the body and is oversized. Slot 44 is several times wider than slot 42 so that the device is able to accommodate ladders having different sizes. For example, as shown in FIG. 5, leg 24 of a relatively narrow ladder fits in slot 44 near its inside end. The leg of a somewhat wider ladder is likewise able to fit in slot 44 although somewhat closer to the outer edge of the slot. Preferably, slot 44 is wide enough to accommodate virtually all commonly available ladders.

In use, the device 10 is applied to gutter 12 by fitting the body 28 on the outer edge of the gutter with the lip 12*d* and the top portion of wall 12*c* received in recess 32. The pins 34 extend partially into the trough 18 and are located behind and in engagement with the free edge of lip 12*d*. The pins are thus hooked onto the lip 12*d* to securely mount the device 10 on the gutter 12. Body 28 engages the upper portion of wall 12*c* in the manner shown in FIG. 2 to further stabilize the mounting of the device.

When the device has been hooked onto the gutter 12 in this manner, the plane of the bearing surface 38 is inclined from vertical at an angle of within a 14° to 20° range which is usually an acceptable angle of inclination for a ladder. The ladder is applied to the device by placing the base of the ladder on the ground and inserting the top end portion of leg 22 in slot 42. The other leg 24 fits in the oversized slot 44.

A worker can then climb up and down on and can work from the ladder 20, and the device 10 prevents the gutter 12 from being damaged. The body 28 provides a cushioning effect and distributes the load which is applied to the ladder along the entire length of the body. Due to the manner in which the body 28 is hooked onto the outer edge of the gutter, the load is effectively transmitted to both the lip 12*d* and the bowed wall 12*c* (see FIG. 2), and this further decreases the likelihood that the gutter will be damaged. The surfaces of body 28 which are in contact with the gutter are soft enough to prevent them from denting the gutter or chipping the paint away from it. At the same time, the bearing surface 38 is spaced away from the gutter so that the body 28 provides a supportive buffer between the ladder and gutter.

The close fit of leg 22 in slot 42 prevents the ladder from sliding sideways in either direction relative to the body 28. Since the body itself is securely hooked in place on the gutter 12 (and since the foam block effectively grips the gutter along its length), the ladder is thus stabilized against sideward sliding movement, and its safety is enhanced accordingly.

When the ladder is to be moved, the device 10 can be applied to the gutter 12 at the new position for the ladder. Preferably, the devices are used in pairs so that a device which is not being used can be placed at a new ladder position by a worker stationed on the ladder.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A device for application to a roof mounted gutter against which a ladder is to be leaned, said device comprising:

a body having a length dimension sufficient to span the width of the ladder and a bearing surface for receiving the ladder;

means for releasably mounting said body on the gutter with the length dimension of the body extending along the gutter and said bearing surface spaced away from the gutter; and means on said bearing surface for maintaining the ladder thereon and preventing the ladder from sliding sidewardly on said bearing surface.

2. A device as set forth in claim 1, wherein said mounting means includes:

a recess in said body in a surface thereof opposite said bearing surface, said recess having a size and shape to be fitted on the gutter; and pin means projecting from said body into said recess and extending into the gutter when said recess is fitted on the gutter, said pin means acting to hold said body on the gutter.

3. A device as set forth in claim 2, wherein said pin means comprises a plurality of pins projecting from said body into the recess.

4. A device as set forth in claim 2, wherein said recess has a generally semi-circular shape and extends along the length dimension of said body.

5. A device as set forth in claim 4, said pin means comprises a plurality of pins projecting from said body into the recess.

6. A device as set forth in claim 1, wherein the gutter includes an outer edge and said mounting means comprises pin means projecting from said body for hooking the body on the outer edge of the gutter.

7. A device as set forth in claim 6, wherein said pin means comprises a pair of parallel pins projecting from said body at locations to be hooked on the outer edge of the gutter.

8. A device as set forth in claim 1, wherein said means on said bearing surface comprises slot means in the bearing surface for receiving the ladder.

9. A device as set forth in claim 8, wherein the ladder includes two legs and said slot means comprises a pair of spaced apart slots in the bearing surface for receiving the ladder.

10. A device as set forth in claim 9, wherein:

one of said slots has a width to closely receive one leg of the ladder therein to prevent the ladder from significant sideward sliding movement on said body; and the other of said slots is wider than said one slot, whereby ladders having various spacings between the legs can be applied to said body with the ladder legs fitting in the slots.

11. A device as set forth in claim 9, wherein said mounting means comprises a plurality of pins projecting from said body at locations to be hooked to the gutter.

12. A device for interposition between a two-legged ladder and a roof mounted gutter having an outer edge against which the ladder is to be leaned, said device comprising:

a substantially rigid body having a bearing surface for receiving the ladder and an opposite surface for presenting a recess applicable to the outer edge of the gutter with the outer edge disposed in said recess;

pin means on said body projecting therefrom into said recess for engagement with the outer edge of the gutter to mount said body thereon; and slot means in said bearing surface for closely receiving at least one of the legs of the ladder in a manner to maintain the ladder against significant sideward sliding on said body.

13. A device as set forth in claim 12, wherein said pin means comprises a plurality of pins projecting from said body into the recess at locations to extend into the gutter to hook said body onto the outer edge thereof.

14. A device as set forth in claim 12, wherein said recess has a generally semi-circular configuration.

15. A device as set forth in claim 12, wherein said slot means comprises a pair of slots in said bearing surface for receiving the legs of the ladder.

16. A device for application to a roof mounted gutter against which a two-legged ladder is to be leaned, said device comprising:

a substantially rigid body having a length dimension greater than the distance between the legs of the ladder and a bearing surface for receiving the ladder;

releasable means for mounting said body on the gutter with said length dimension extending along the gutter and said bearing surface facing generally away from the gutter;

a pair of slots in said bearing surface spaced apart from one another to receive the legs of the ladder, one of said slots having a width to closely receive one leg of the ladder in a manner to assist in preventing the ladder from sliding sidewardly on said body and the other slot being wider than said one slot to accommodate ladders having various spacings between the legs thereof.

17. A device as set forth in claim 16, wherein said releasable means comprises a plurality of pins projecting from said body at locations to hook onto the gutter to mount said body thereon.

18. A device as set forth in claim 16, wherein said releasable means comprises:

a recess in said body in a surface thereof opposite said bearing surface, said recess having a size and shape to be fitted on the gutter; and pin means projecting from said body into said recess and extending into the gutter when said recess is fitted on the gutter, said pin means acting to hold said body on the gutter.

19. A device as set forth in claim 18, wherein said pin means comprises a plurality of pins projecting from said body into said recess.

20. A device as set forth in claim 18, wherein said recess has a generally semi-circular shape and extends along the length dimension of said body.

* * * * *